United States Patent [19]

Rikker

[11] Patent Number: 5,012,857

[45] **Date of Patent: * May 7, 1991**

[54] MOLDING MEDIUM, METHOD FOR MAKING SAME AND EVAPORATIVE PATTERN CASTING PROCESS

[76] Inventor: Leslie D. Rikker, 15441 Betty Ann La., Oak Forest, Ill. 60452

[ * ] Notice: The portion of the term of this patent subsequent to Mar. 24, 2004 has been disclaimed.

[21] Appl. No.: 883,103

[22] Filed: Jul. 8, 1986

Related U.S. Application Data

[62] Division of Ser. No. 651,291, Sep. 17, 1984, Pat. No. 4,651,798.

[51] Int. Cl.[5] ..... B22C 9/04

[52] U.S. Cl. ..... 164/529; 164/34; 164/520; 106/38.3; 106/38.9

[58] Field of Search ..... 164/14, 34, 35, 36, 164/138, 520, 529; 106/38.3, 38.9; 428/404; 427/215, 219, 224, 226, 370, 376.2

[56] References Cited

U.S. PATENT DOCUMENTS

| | | | |
|---|---|---|---|
| 3,069,292 | 12/1962 | Alexander et al. | 428/404 |
| 3,934,637 | 1/1976 | Potier | 164/138 |
| 4,010,791 | 3/1977 | Hetke et al. | 164/34 |
| 4,243,420 | 1/1981 | Sakai et al. | 164/15 |
| 4,491,482 | 1/1985 | Hori | 428/404 |

FOREIGN PATENT DOCUMENTS

| | | | |
|---|---|---|---|
| 45-12841 | 5/1970 | Japan | 164/14 |
| 45-32822 | 10/1970 | Japan | 106/38.9 |
| 50-87104 | 5/1975 | Japan | 428/404 |
| 57-11746 | 1/1982 | Japan | 164/138 |
| 3136888 | 4/1983 | Japan | 106/38.3 |

*Primary Examiner*—Richard K. Seidel
*Attorney, Agent, or Firm*—Kenyon & Kenyon

[57] ABSTRACT

A molding medium and process for making it, preferably for use in the evaporative pattern casting process, is disclosed. The molding medium comprises, in one embodiment, a base granular molding material having spherically shaped grains wherein the individual grains of the material are coated with a refractory material. Preferably the grains are coated first with a binding agent and then mixed with a refractory material, which may be zirconium oxide. After coating, the material is fired at a high temperature, crushed and screened to size, according to one method. Alternatively, the base molding material may itself be a refractory material, in which case the refractory material is mixed with a binding agent to agglomerate the base material into substantially spherical particles and a refractory coating need not be applied. In either embodiment, substantially spherical free-flowing particles are produced having a low angle of repose. This allows the molding medium to come into close contact with the pattern of the object to be cast. Furthermore, the use of a refractory coating for the particles of the molding medium or a refractory material for the molding medium itself eliminates the need for a refractory wash or coating on the pattern.

36 Claims, No Drawings

MOLDING MEDIUM, METHOD FOR MAKING SAME AND EVAPORATIVE PATTERN CASTING PROCESS

This is a division of application Ser. No. 651,291 filed Sept. 17, 1984 now U.S. Pat. No. 4,651,798.

BACKGROUND OF THE INVENTION

The present invention relates to molding media and materials, and particularly to a molding medium for use in the evaporative pattern casting process, and even more particularly, to a free flowing molding medium for use in the evaporative pattern casting process which does not require a refractory coating to be applied to the evaporative pattern. The invention further relates to an evaporative pattern casting process wherein free flowing molding material is used and wherein the pattern is not coated with a refractory material.

In the evaporative pattern casting process, a form or pattern, generally comprising polystyrene foam, of the item to be cast is made. The foam pattern is placed in a pouring box and embedded in a molding material. A foam leader leads from the pattern to the upper surface of the molding material, providing a passageway for the molten metal. Molten metal is then poured into the pouring box, with the result that the molten metal evaporates the pattern, thus displacing it. The metal is allowed to cool and the cast item can be removed from the pouring box once it has cooled. See, e.g., U.S. Pat. No. 2,830,343 to Shroyer.

In a further refinement of the evaporative pattern casting method, the molding material is unbonderized and free flowing. The free flowing material is poured into the pouring box and compacted so as to completely surround the foam pattern and the leader. The molten metal is then poured into the box, and it has been theorized that, upon contact with the cooler molding material, the polystyrene evaporated by contact with the molten metal will condense and thus retain the unbonded molding material in position a sufficient length of time to support the entering molten metal displacing the pattern. See, e.g. U.S. Pat. No. 3,157,924 to Smith. Experiments have indicated, however, that it is the formation of gases due to the evaporation of the foam pattern that allows the unbonded molding material to remain in position.

The evaporative pattern process has great potential to be adopted widely in the foundry industry as an economical and environmentally safe casting production process. To date, however, this potential has not been fully realized because of the present method and materials that are used for moldings.

Presently, to produce a casting with an acceptable reliability and quality using the evaporative pattern casting process, the following steps are required after the successful production and assembly of the disposable pattern:

1. A so-called wash is produced and applied uniformly over the surfaces of the evaporative pattern. The "wash" can be as described in U.S. Pat. Nos. 2,701,902, 2,829,060, 3,498,360, 3,314,116, 3,169,288, 3,351,123, or 3,270,382, British Patent No. 1,281,082, or many other different proprietary brands which all have one thing in common: a finely ground refractory material such as aluminum, zirconium or silica flour is emulsified and suspended in a carrying agent, the most commonly used such material being water or alcohol.

2. This coating material, after its application onto the pattern, then has to be dried. As the result of the evaporation of the water or alcohol or the setting up of the carrying agent, a thin shell is produced around the pattern, coating all surfaces of the evaporative pattern.

3. The dried and coated pattern is inserted or invested into a dry free-flowing molding material such as silica sand of a specific grain fineness disposed in a pouring box.

4. During the investment of the pattern into the molding medium, the molding medium is either aerated, using air or other gas, or vibrated to reduce the angle of repose of the sand close to 0°, thus allowing the sand to flow into and fill all areas and inner and outer cavities of the pattern. By angle of repose is meant the angle of a cone formed by pouring the molding medium onto a flat surface. The lower the angle, the closer the material is to a liquid, which essentially takes the shape of the container into which it is poured.

5. The sand then is densified or compacted to provide support for the weight of the liquid metal to be poured into the pouring box.

6. A weight or other blockage means is placed on the top of the molding medium in the pouring box.

7. The mold is filled with liquid metal, thus evaporating the pattern.

8. After the liquid metal has solidified, the weight is removed and the casting and sand are dumped out of the pouring box.

9. The casting is then sent to the cleaning room to be cleaned and readied for shipment.

With the above described procedure, castings of good quality can be produced at present. There are, however, a number of problems remaining with the technique described above. Some problems, for example, are in the areas of the finished casting quality and economics. The refractory coated pattern, depending on the thickness of the coating, will produce a casting which will also be coated with the refractory material which adheres to the molten metal. Since the refractory material is made up of fine particles and these particles tend to cling together, their removal is quite critical, especially for castings that are used for internal combustion engines such as engine blocks or cylinder heads. Any particle which is not removed will then stay in the cooling system and may eventually destroy the coolant pump or its seal or clog up the coolant system radiator. In other areas it may become mixed with the engine lubricant, in which instance it may lead to premature engine wear or failure.

In addition, the coating of the pattern and the drying operation is costly and energy intensive and affects the quality of the casting. Furthermore, the molding medium used with these coating materials is usually dry free-flowing silica sand, which is not environmentally safe since it contains free silica. Additionally, the angle of repose of such sand is around 35° and when compacted it can reach 45°. This angle of repose affects, to a great extent, the ability of the molding medium to fill in the internal cavities, etc. without manual intervention. This is in large part due to the creation of differential pressures in the molding material because the large angle of repose prevents the molding material from behaving like a liquid and generating essentially a uniform pressure in all areas of the interface between the pattern and molding medium. As a result, in some areas of the pattern-molding medium interface, sufficient pressures will not be developed against the pattern to keep the molding medium in place when the molten metal enters the mold, thus causing imperfect castings.

Another effect is that of shrinkage of the molding medium. For example, sand, when compacted, can reduce its volume by as much as 20%. This again hinders some of the ability of the molding medium to properly fill in the inner cavities of a disposable pattern. Due to the shrinkage of the sand as a result of the random grain structure, deformation of the flexible foam pattern may occur, again resulting in imperfect castings. To counter this, the conventional approach has been to apply a heavier refractory coating to the pattern to protect the pattern and/or to reduce the amount of compaction. Both of these measures, however, may result in considerable inacuracy in the finished casting and with respect to the application of a heavier coating, increased drying times and cost.

Although the above problems must be dealt with when using the evaporative pattern casting process, good castings can be produced with this process if the necessary precautions are followed and steps taken.

SUMMARY OF THE INVENTION

The present invention is intended to solve a number of the above problems. One embodiment of the present invention provides a new molding medium which may be produced by coating an environmentally safe base particulate material with a binding agent, and thereafter coating the particulate material with a refractory coating. Environmentally safe, man-made materials are preferably used, rather than a natural product such as sand in order to avoid the harmful effects of free silica. If sand is used, however, a round grain variety is preferably used, the surface of the sand grain being coated with a binding agent and then a refractory material. Alternatively, glass bead may be coated with a binding agent and thereafter with a refractory material.

In another alternative embodiment for the molding medium, particulate material which is not approximately spherical in shape may be used. The particulate grains are agglomerated or pelletized by mixing the grains with a binding agent. In one embodiment, the particulate material itself may be a refractory material, in which case the particulate material need not be coated with a refractory material. In another embodiment, the particulate material is coated with a refractory material to provide the necessary refractory characteristics. The agglomerated grains are approximately spherical in shape and may be produced in a wide spectrum of round grains, thus approximating the best theoretical shape and size for the particular casting. Due to the round shape of the granules, the angle of repose is approximately 15°–20°, and with such a low angle of repose, the filling of inner cavities occurs more easily and is more predictable. Such material will change volume in a predictable manner, not like angular grain materials, therefore making the casting process easier and more predictable. Also, the permeability to gas of the molding medium is predictable and repeatable throughout the pattern-molding medium interface.

Since the grains may be agglomerated or pelletized, a number of materials can be combined to produce the desired characteristic of the molding medium for each metal group, therefore allowing the "engineering" or designing of the molding medium for the casting to be produced.

The round grain structure provides for uniform compaction, a lower angle of repose and therefore a more fluid molding medium which is able to take the shape of intricate patterns and uniform pressure on the pattern surface, avoiding the differential pressure mentioned above. This uniform pressure further eliminates one of the reasons for the application of the refractory wash. Additionally, the round grain structure provides an effective vehicle for carrying a refractory coating and for insuring that the refractory coating comes into contact with the pattern at the pattern-molding medium interface. Furthermore, the grains can be agglomerated using a refractory material such as zirconium oxide, as the base particulate material, thus eliminating completely the need for the wash. The agglomerated or pelletized grains preferably are held together by a binding agent such as sodium silicate or potassium silicate and the grains are fired to at least 400° C. to set the silicate. Other binders may be used, although the silicate will provide the most environmentally safe material. If round sand grain is used as the base molding material, the sand surface is thus coated, eliminating the free silica and thus producing an environmentally safe sand-based moulding material.

After coating or agglomeration with a binding agent and firing, according to one method of production, the molding material then may be crushed back along the refractory boundary lines to the new coated grain size and screened to a specific grain distribution and is ready for use.

By the application of the coated, agglomerated or pelletized grains, several types of molding media can be created specifically suiting the metallurgy of the metal to be cast. For instance, by the addition of a reductant such as a carbon-containing material, for example, a reducing atmosphere can be created around the casting, therefore eliminating or greatly reducing the scaling of the casting. In other instances, an oxidizing aspect may be desirable. For example, it may be desirable to create an oxidizing atmosphere to remove excess carbon in objects being cast. At elevated temperatures, the molding media directly adjacent to the casting may fuse, depending on metal temperature, and may be discarded like a scale. Only the amount which has fused need be discarded. This discarded material is environmentally safe since it does not have any organic component and has no high concentration of metal impurity.

DETAILED DESCRIPTION

The molding medium according to the present invention may be produced in several alternative ways as described in more detail below.

A. Naturally found round grained silica, such as sand, is subjected to the normal treatment and the specific screen distribution (grain distribution) required for that type of casting is used. Once such size has been established, the molding medium production then takes the following steps: the grain surfaces are thoroughly coated with a binder agent such as sodium silicate diluted with water to perhaps 50% strength for an 80 fineness round grain sand. Approximately 2% of water by weight and 2% of full strength sodium silicate is used. Then the grain surfaces are coated with a dry zirconium oxide flour of minus 324 mesh, 6% by weight, and minus 200 mesh, 4% by weight. The total percentage of the zirconium oxide depends on the total grain surface area. After the grain surface has been coated, the mixture is put into a kiln and fired at 1000° F. for five hours. The mixture then is crushed and screened back to its original grain size with the coating in place.

B. The second method uses a round shaped glass of a specific screen size as the base material. The glass surfaces then are coated and screened as in the method previously described.

C. In a third method, each grain is agglomerated or pelletized with a binding agent from one or a number of powders such as zirconium oxide, aluminum oxide, graphite or other materials that have characteristics suited for purposes described herein, e.g., refractory material, reductant, oxidizing agent, insulator or heat sink, etc. These materials are granulated with the binding agent such as a solution of water and sodium silicate and screened to the specific grain distribution desired. After such a screening, the pellets are fired at 1000° F. to set the sodium silicate. A variation on this method provides that the sodium silicate is replaced perhaps with another binding agent and the pellets are fired to much higher temperatures suited for the binder used and fused, creating a structure similar to sintered iron ore pellets.

Furthermore, non-refractory material may be used as the base particulate material. The base particulate material is then agglomerated with a binding agent and coated, as discussed above.

Accordingly, a new molding medium has been described that is made of engineered grains of molding material. The grains may be agglomerated or pelletized from one or more fine materials suitable for the metal used in the casting process so as to produce substantially spherical round particles having a low angle of repose. Alternatively, a base particulate material having an approximately spherical grain structure may also be used, and the grains coated with a binding agent and a refractory coating. As a result of the grain distribution and of the preferred step of coating the grains with a refractory material such as zirconium oxide, the need to wash the pattern with a refractory wash is eliminated. The elimination of the wash provides several benefits, most notably, the cost associated with the elimination of the drying operation, both capital and operating cost. Furthermore, by the engineering of the grain, and therefore the molding medium, specific characteristics of molding media can be obtained. By coating the grains with refractory material, free silica is eliminated, rendering the molding media environmentally safe, if e.g., sand is used as the base molding material. Additionally, by eliminating the wash and thus the need for a drying process, logistic problems are greatly reduced and pattern shrinkage in storage can be controlled with more accuracy. By eliminating the wash, the matching of the molding medium to more complex pattern shapes is simplified and furthermore need not be as accurate. Since the granules are not as fine as the wash, no inner fins are produced on the casting and cleaner castings can be obtained. Additionally, the molding medium according to the invention can be reused repeatedly before it becomes worn out through the loss of the refractory coating, for example.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly to be regarded in an illustrative rather than a restrictive means.

What is claimed is:

1. A molding medium for use in forming castings by the evaporative pattern casting process wherein a flowable, unbound molding medium is provided for surrounding an evaporative pattern disposed in a casting box, the molding medium comprising a base particulate material, said base particulate material comprising particles having a substantially spherical shape formed by man and not found in nature, said substantially spherical particles being unbound from each other, the spherical shape of said particles allowing said particles of said molding medium to come into intimate contact with said evaporative pattern, said base particulate material further comprising a refractory material component, said refractory material component eliminating the need for a refractory wash coat to be applied to the evaporative pattern, said refractory material component comprising a refractory material deposited on the surfaces of the particles of the base particulate material.

2. The molding medium recited in claim 1 wherein said particulate material comprises silica sand.

3. The molding medium recited in claim 1 wherein said base particulate material comprises a material selected from the group consisting of aluminum oxide, zirconium oxide or a carbon containing material.

4. The molding medium recited in claim 1 wherein said base particulate material comprises glass bead.

5. The molding medium recited in claim 1, wherein said refractory material comprises zirconium oxide.

6. The molding medium recited in claim 1, further comprising a binding agent deposited on the surfaces of said particles, said refractory coating adhering to said binding agent.

7. The molding medium recited in claim 6 wherein said binding agent comprises an aqueous solution of a material selected from at least one of sodium silicate or potassium silicate.

8. The molding medium recited in claim 1 wherein said refractory component comprises said base particulate material comprising at least one of aluminum oxide and zirconium oxide.

9. The molding medium recited in claim 1, further comprising a substance for creating a reducing atmosphere around the particles of the base particulate material.

10. The molding medium recited in claim 9 wherein said substance comprises a carbon containing material.

11. A molding medium for use in forming castings by the evaporative pattern casting process wherein a flowable, unbound molding medium is provided for surrounding an evaporative pattern disposed in a casting box, the molding medium comprising a base particulate material, said base particulate material comprising particles having a substantially spherical shape formed by man and not found in nature, said substantially spherical particles being unbound from each other, the spherical shape of said particles allowing said particles of said molding medium to come into intimate contact with said evaporative pattern, said base particulate material further comprising a refractory material component, said refractory material component eliminating the need for a refractory wash coat to be applied to the evaporative pattern, said base particulate material comprising particulate material mixed with a binding agent so as to produce agglomerated, substantially spherical particles comprising joined ones of said particles of said particulate material, each of said agglomerated, substantially spherical particles being unbound from other ones of the agglomerated substantially spherical particles.

12. A method for producing a molding medium for forming castings by the evaporative pattern casting process wherein a flowable, unbound molding medium is provided for surrounding an evaporative pattern disposed in a casting box, the method comprising the steps of coating particles of a base particulate material having particles having a substantially spherical shape formed by man and not found in nature with a refractory material, and maintaining said substantially spherical particles unbound from each other, the spherical shape of said particles allowing said particles of said molding medium to come into intimate contact with said evaporative pattern, said refractory material eliminating the need for a refractory wash coat to be applied to the evaporative pattern.

13. The method recited in claim 12, further comprising the step of coating the particles with a binding agent prior to coating said particles with a refractory coating, said refractory coating adhering to said binding agent.

14. The method recited in claim 13 wherein said binding agent comprises an aqueous solution of sodium silicate or potassium silicate.

15. The method recited in claim 13, further comprising the step of firing the particulate material after coating with said binding agent and said refractory material.

16. The method recited in claim 15 wherein said step of firing comprises heating the material to a temperature of at least 400° C.

17. The method recited in claim 16 wherein said step of firing comprises heating the material to a temperature of at least 1000° F. for at least five hours.

18. The method recited in claim 15, further comprising the step of crushing the fired particulate material.

19. The method recited in claim 18, further comprising the step of screening the crushed material to its original size.

20. The method recited in claim 15, further comprising the step of screening the particulate material to its original size prior to firing.

21. The method recited in claim 12 wherein said base particulate material comprises silica sand having particles having a substantially spherical shape.

22. The method recited in claim 12 wherein said base particulate material comprises glass bead.

23. The method recited in claim 12 wherein said base particulate material is formed by the step of agglomerating particles of said base particulate material with a binding agent, the thus formed agglomerated particles having a substantially spherical shape, said agglomerated particles being unbound from other ones of the agglomerated particles.

24. A method for producing a molding medium for forming castings by the evaporative pattern casting process wherein a flowable, unbound molding medium is provided for surrounding an evaporative pattern disposed in a casting box, the method comprising the steps of mixing a base particulate material having particles having a substantially spherical shape formed by man and not found in nature with a binding agent thereby to coat said particles with said binding agent, and firing the mixture, said mixture having a refractory component, said refractory component comprising a coating formed by the steps of coating said particles of said base particulate material with said binding agent and mixing a refractory material with said particles, said refractory material adhering to said binding agent and eliminating the need for a refractory wash coat to be applied to the evaporative pattern.

25. The method recited in claim 24 wherein the base particulate material is a refractory powder.

26. The method recited in claim 25 wherein the refractory powder comprises a material selected from the group consisting of zirconium oxide or aluminum oxide.

27. The method recited in claim 26 wherein said binding agent comprises an aqueous solution of sodium silicate or potassium silicate.

28. The method recited in claim 24 wherein said step of firing comprises firing to a temperature of at least 400° C.

29. The method recited in claim 24, further comprising the step of screening the mixture prior to firing.

30. The method recited in claim 24, further comprising the step of mixing said base particulate material with a material for creating one of a reducing atmosphere and an oxidizing atmosphere around said particulate material.

31. A method for producing a molding material for forming castings by the evaporative pattern casting process wherein a flowable, unbound molding medium is provided for surrounding an evaporative pattern disposed in a casting box, the method comprising the steps of mixing a base particulate material having particles having a substantially spherical shape formed by man and not found in nature with a binding agent to form agglomerated, substantially spherical particles, coating the agglomerated particles of the mixture covered by the binding agent with a refractory material and firing the mixture, said refractory material coating eliminating the need for a refractory wash coat to be applied to the evaporative pattern, the substantially spherical shape of said particles allowing the particles to come into intimate contact with said evaporative pattern.

32. The method recited in claim 31, further comprising the step of crushing the mixture along refractory boundary lines formed by said step of coating to approximately the size of individual ones of the coated particles, substantially retaining the spherical shape of the base particulate material.

33. The method recited in claim 32 wherein said binding agent comprises an aqueous solution of sodium silicate or potassium silicate.

34. The method recited in claim 32 wherein said step of coating comprises coating with zirconium oxide or aluminum oxide.

35. The method recited in claim 32, further comprising the step of coating the particles with a substance for creating a reducing atmosphere or an oxidizing atmosphere around the particles.

36. The method recited in claim 32, wherein said step of firing comprises heating the mixture to at least 1000° F. for 5 hours.

* * * * *